US008063006B2

(12) United States Patent
Chen et al.

(10) Patent No.: US 8,063,006 B2
(45) Date of Patent: Nov. 22, 2011

(54) AQUEOUS CLEANING COMPOSITION FOR SEMICONDUCTOR COPPER PROCESSING

(75) Inventors: Chien Ching Chen, Lu-Chuh Hsiang (TW); Wen Cheng Liu, Lu-Chuh Hsiang (TW); Jing-Chiuan Shiue, Lu-Chuh Hsiang (TW); Teng Yan Huo, Lu-Chuh Hsiang (TW)

(73) Assignee: Epoch Material Co., Ltd., Kaohsiung County (TW)

( * ) Notice: Subject to any disclaimer, the term of this patent is extended or adjusted under 35 U.S.C. 154(b) by 961 days.

(21) Appl. No.: 11/436,749

(22) Filed: May 18, 2006

(65) Prior Publication Data

US 2007/0066508 A1 Mar. 22, 2007

(30) Foreign Application Priority Data

May 19, 2005 (TW) ..... 94116223 A

(51) Int. Cl.
*C11D 1/00* (2006.01)

(52) U.S. Cl. ..... 510/175; 438/692; 134/2; 134/3

(58) Field of Classification Search ..... 510/175; 438/692; 134/2, 3

See application file for complete search history.

(56) References Cited

U.S. PATENT DOCUMENTS

| | | | | |
|---|---|---|---|---|
| 6,280,652 | B1 | 8/2001 | Inoue et al. | |
| 6,372,050 | B2 | 4/2002 | Honda et al. | |
| 6,825,156 | B2 | 11/2004 | Lee et al. | |
| 6,852,144 | B1 | 2/2005 | Wagner et al. | |
| 2003/0186175 | A1 | 10/2003 | Ikemoto et al. | |
| 2003/0228990 | A1 | 12/2003 | Lee et al. | |
| 2004/0029051 | A1 | 2/2004 | Koita et al. | |
| 2004/0048761 | A1 * | 3/2004 | Ikemoto | 510/175 |
| 2004/0092106 | A1 * | 5/2004 | Martyak et al. | 438/689 |
| 2004/0149309 | A1 * | 8/2004 | Hsu | 134/3 |
| 2005/0090109 | A1 * | 4/2005 | Carter et al. | 438/692 |
| 2005/0096237 | A1 | 5/2005 | Miyazawa et al. | |
| 2006/0293208 | A1 * | 12/2006 | Egbe et al. | 510/407 |

FOREIGN PATENT DOCUMENTS

| | | |
|---|---|---|
| DE | 199 47 845 | 4/2001 |
| DE | 103 38 563 | 3/2005 |
| EP | 0 962 508 | 12/1999 |
| EP | 1 031 884 | 8/2000 |

OTHER PUBLICATIONS

English abstract of DE 103 38 563 dated Mar. 17, 2005.
English abstract of DE 199 47 845 dated Apr. 12, 2001.
Computer-Generated English Translation of Specification and Claims and Patent Abstracts of Japan of 10-171130 dated Jun. 26, 1998.
Patent Abstracts of Japan of 2003-292993 dated Oct. 15, 2003.
Derwent Abstract of JP 2005-336342 dated Dec. 8, 2005.

* cited by examiner

*Primary Examiner* — Harold Pyon
*Assistant Examiner* — Timothy Chiang
(74) *Attorney, Agent, or Firm* — Thomas E. Omholt; Steven D. Weseman

(57) ABSTRACT

The invention relates to an aqueous cleaning composition for wafers with copper wires that have been treated by chemical mechanical planarization in an integrated circuit processing, comprising 0.1 to 15 wt % of a nitrogen-containing heterocyclic organic base, 0.1 to 35 wt % of an alcohol amine and water. Upon contact with copper-containing semiconductor wafers that have been treated by chemical mechanical planarization for an effective period of time, the aqueous cleaning composition can effectively remove residual contaminants from the surfaces of the wafers, and simultaneously provide the copper-containing semiconductor wafers with a better surface roughness.

8 Claims, 2 Drawing Sheets

AQUEOUS CLEANING COMPOSITION FOR SEMICONDUCTOR COPPER PROCESSING

FIELD OF THE INVENTION

The invention relates to an aqueous cleaning composition used in post chemical mechanical planarization (CMP) in integrated circuit processing.

BACKGROUND OF THE INVENTION

Semiconductor elements nowadays are developing toward the trend of smaller line width and higher integrated density. When the minimum line width of an integrated circuit is decreased below 0.25 μm, the time delay (RC delay) caused by the resistance of the metal wire itself and the spurious capacitance of the dielectric layer has become a crucial influence on the operation rate of the elements. Therefore, in order to increase the operation rate of the elements, currently copper metal wires have been gradually adopted in high-level processing below 0.13 μm to replace the traditional aluminum-copper alloy wires.

The application of chemical mechanical planarization technology in the copper metal wire processing may not only overcome the problem of patterns being difficult to define due to the difficulty of copper metal etching, but also form a plane with global planarity upon polishing, so that the multilayer wire processing may be easily carried out. The principle of chemical mechanical planarization is that mechanical wear is produced on the wafer surface by combining polishing particles in a polishing slurry with chemical aids, whereby the high site of the uneven surface has a high removal rate due to high pressure while the low site of the uneven surface has a low removal rate due to low pressure, and thereby the purpose of global planarity can be achieved.

Large quantities of fine polishing particles and chemical aids in the polishing slurry and the scraps peeled during polishing may attach to the chip surface during polishing of the chemical mechanical planarization. In general, the common contaminants found on the chips after polishing are metal ions, organic compounds and polishing particles and the like. If there is no effective cleaning procedure to remove the above-described contaminants, the subsequent processing will be affected, and the yield and the reliability of the elements will be decreased. Therefore, the cleaning processing after CMP polishing has become a crucial technology to determine whether CMP can be successfully applied in semiconductor processing.

In the polishing slurry used in copper processing, benzotriazole (BTA) and its derivatives and ascorbic acid are often employed as a corrosion inhibitor. In the contaminants found on the wafers after polishing in the copper processing, organic residues such as BTA, etc. are the most difficult to remove, mainly because the BTA particles are bonded on the copper wires by chemical adsorption. Physical removal methods such as static repulsive force, ultrasonic vibration and scrubbing with a polyvinyl alcohol (PVA) brush etc., are traditionally used, but it is not easy to obtain a good cleaning effect.

Traditional inter layer/metal dielectric and W plugs that have been treated by chemical mechanical planarization are usually cleaned using ammonia solution and/or fluorine-containing compounds, but the above solutions are not suitable for the wafers of copper metal wires. The ammonia solution will unevenly corrode the surface of copper metal, resulting in coarsening. The fluorine-containing compounds will not only coarsen the copper surface but also cost more in terms of human safety protection and waste solution treatment in order to avoid doing harm to human health and to the environment.

A polishing composition that can effectively remove tantalum metal from a substrate is disclosed in Ina et al., U.S. Pat. No. 6,139,763, which consists of polishing particles, an oxidant that can oxidize tantalum metal, a reducer that can reduce tantalum oxide (such as oxalic acid) and water. This polishing composition can further comprise piperazine (a nitrogen-containing heterocyclic organic base). According to Ina et al.'s teaching, the piperazine can be used on the surface of the copper layer during polishing to prevent the formation of surface impairment, such as recesses, dishing or erosion, which also can protect the polishing surface so as to achieve a mirror-like surface. However, the use of the piperazine in an aqueous cleaning solution employed in the post chemical mechanical planarization in the copper processing is not taught or suggested by Ina et al.

A method of removing chemical residues from a surface of a metal or dielectric layer is disclosed in Small, U.S. Pat. No. 6,546,939 (Taiwan Patent No. 396202), wherein an aqueous composition with a pH between 3.5 and 7 is placed in contact with the metal or dielectric layer for a period of time sufficient to remove the chemical residues. This aqueous composition comprises an organic acid having mono-, bi- or trifunctional groups, a buffering amount of a base of quaternary amine, ammonium hydroxide, hydroxylamine, hydroxylamine salt or hydrazine salt, and a choline hydroxide.

A cleaning agent is disclosed in Small et al., U.S. Pat. No. 6,498,131. The cleaning agent consists of a nonionic surfactant, amines, quaternary amines and a surface retention agent selected from ethylene glycol, propylene glycol, polyethylene oxide and mixtures thereof, and is used to clean the residues of the chemical mechanical planarization processing.

A cleaning agent is disclosed in Naghshineh et al., U.S. Pat. No. 6,492,308. The cleaning agent consists of tetraalkylammonium hydroxide, polar organic amine and a corrosion inhibitor, and is used to clean a copper-containing integrated circuit.

A cleaning agent is disclosed in Nam, U.S. Pat. No. 5,863,344. The cleaning agent consists of tetramethylammonium hydroxide, acetic acid and water, and is used to clean semiconductor elements, wherein the volume ratio of acetic acid to tetramethylammonium hydroxide is preferably 1 to about 50.

A method of cleaning a semiconductor substrate with copper wires on its surface is disclosed in Masahiko et al., U.S. Pat. No. 6,716,803. The cleaning agent used in this method comprises a surfactant and a nitrogen-containing alkaline substance.

A cleaning agent is disclosed in Ward et al., U.S. Pat. No. 5,988,186. The cleaning agent consists of a water-soluble polar solvent, an organic amine and a benzene ring corrosion inhibitor, and is used to remove organic and inorganic substances.

A tetraalkylammonium hydroxide and/or a surfactant and/or a corrosion inhibitor are used as the components of the cleaning solution in the prior art as described above. Tetraalkylammonium hydroxides have a high volatility (a vapor pressure of 18 mm Hg at a temperature of 20° C.), high toxicity and strong odour. If it is not handled appropriately, it will cause damage to humans and the environment. The cleaning effect of the cleaning composition can be enhanced by way of adding the surfactant or changing the surface electrical property of the contaminant and/or the substrate, but this cannot act on contaminants produced by chemical adsorption. The corrosion inhibitor can protect the surface of copper metal during cleaning to avoid the excessive corrosion of the copper metal surface induced by the chemical substances in the cleaning composition. However, the corrosion inhibitor itself may remain on the surface of copper metal after cleaning, resulting in organic residues.

Therefore, the prior art as described above cannot meet the requirements for a cleaning solution used in post chemical mechanical planarization in copper processing in the industry. There is still a desire for an aqueous cleaning composition useful for post chemical mechanical planarization in the copper processing. This ideal composition would be one which is not highly volatile, has no odour, doesn't remain on the wafers after cleaning, and can effectively remove the residual contaminants from the surfaces of the copper process chips that have been treated by chemical mechanical planarization and provide the copper metal wires with a better surface roughness.

SUMMARY OF THE INVENTION

The main objective of the invention is to provide an aqueous cleaning composition used in post chemical mechanical planarization in copper processing, comprising a nitrogen-containing heterocyclic organic base, an alcohol amine and water. Upon contact with copper-containing semiconductor wafers that have been treated by a chemical mechanical planarization for an effective period of time, the aqueous cleaning composition of the present invention can effectively remove residual contaminants from the surfaces of the wafers, and simultaneously provide the copper wires with a better s surface roughness.

A feature of the present invention is to avoid using volatile components such as tetraalkylammonium hydroxide (e.g. tetramethylammonium hydroxide), so as to decrease the potential hazards regarding the escape of solution into the environment and to human health. Another feature of the present invention is to effectively remove the residual contaminants from the surfaces of the wafers after polishing, without using a surfactant and a corrosion inhibitor (such as BTA and/or its derivatives, ascorbic acid, and the like) used for protecting the copper surface during cleaning, and to simultaneously provide the copper wires with a better surface roughness, so as to avoid the possibility that the surfactant and the corrosion inhibitor remain on the wafers.

DETAILED DESCRIPTION IF THE INVENTION

Figure 1:
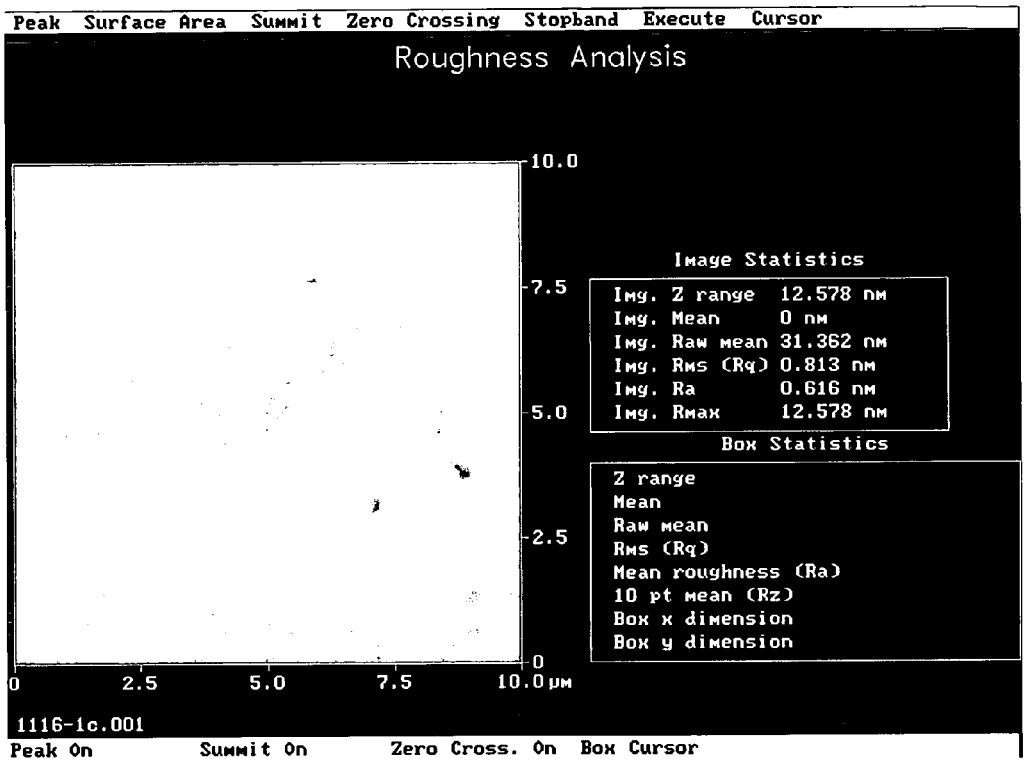
FIG. 1 shows the atomic force microscope (AFM) image of the copper chips cleaned with the cleaning composition of the present invention (No. 1).
Figure 2:
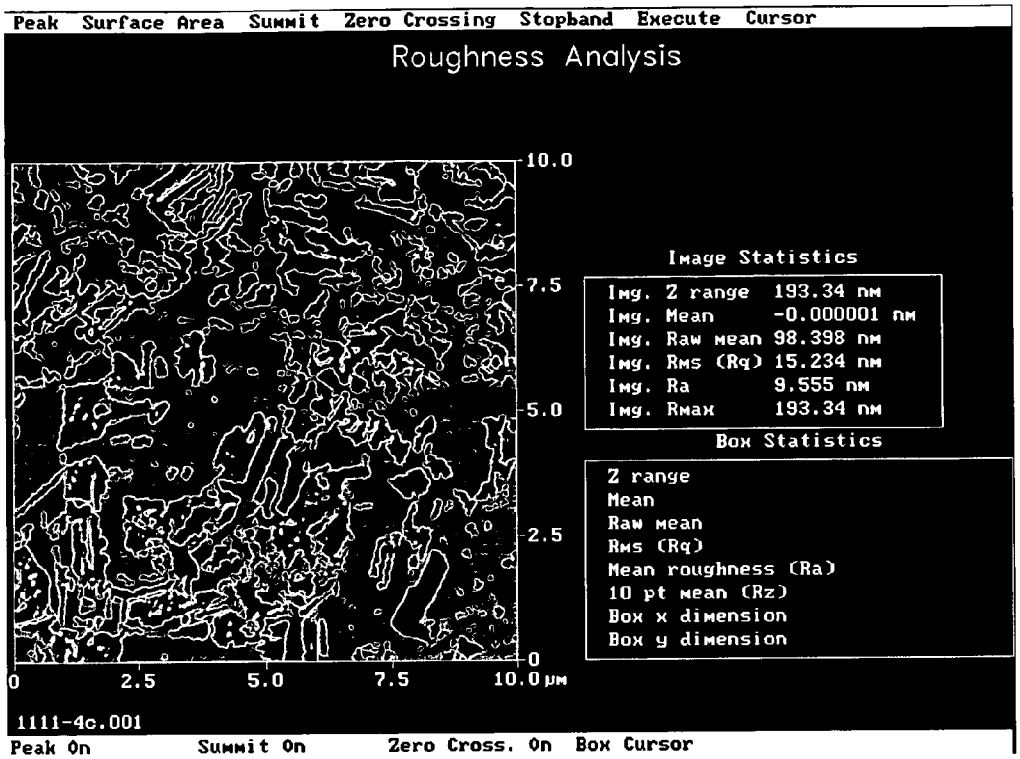
FIG. 2 shows the atomic force microscope (AFM) image of the copper chips cleaned with an improper cleaning composition (No. 12).

The aqueous cleaning composition of the invention includes, based on the total weight of the composition, 0.1 to 15 wt % of a nitrogen-containing heterocyclic organic base, 0.1 to 35 wt % of an alcohol amine and water.

In the aqueous cleaning composition of the invention, the nitrogen-containing heterocyclic organic base is used to increase the basicity of the composition, thereby avoiding the use of ammonia solution that can cause serious coarsening of the copper surface, volatile tetramethylammonium hydroxide, and alkali metal hydroxides that will cause metal-ion contamination. On the other hand, the unshared electron pairs of the nitrogen atom on the heterocyclic ring of the nitrogen-containing heterocyclic organic base will bond with the copper wires, so as to prevent the re-adsorption of the organic contaminants that have left the copper wires.

The nitrogen-containing heterocyclic organic base used in the invention is preferably selected from the group consisting of piperazine, 2-(1-piperazine)ethanol, 2-(1-piperazine)ethylamine, and a combination thereof, and more preferably piperazine. The amount of the nitrogen-containing heterocyclic organic base used in the invention ranges from 0.1 to 15 wt %, preferably 0.1 to 10 wt %, and more preferably 0.2 to 10 wt %, based on the total weight of the composition.

The alcohol amine used in the invention is preferably selected from the group consisting of ethanolamine, diethanolamine, triethanolamine, propanolamine, and a combination thereof, and more preferably selected from the group consisting of diethanolamine, triethanolamine, and a combination thereof. The amount of the alcohol amine used in the invention ranges from 0.1 to 35 wt %, preferably 0.1 to 30 wt %, and more preferably 0.5 to 25 wt %, based on the total weight of the composition.

As described above, the corrosion inhibitor (such as BTA or its derivatives or ascorbic acid) used in the polishing slurry for chemical mechanical planarization in copper processing may remain on the surfaces of the wafers after polishing. These organic residues are difficult to remove using only commonly known physical methods such as static repulsion force, ultrasonic vibration, and scrubbing with a polyvinyl alcohol (PVA) brush.

The nitrogen-containing heterocyclic organic base and the alcohol amine compounds contained in the cleaning composition of the invention can increase the saturated solubility of the organic residues (such as BTA) in the cleaning composition, so as to provide a higher driving force to dissolve the BTA particles. A better cleaning effect can be achieved by combining a traditional physical removal method with the cleaning composition of the present invention.

The cleaning composition of the invention can be used directly, or can be used after dilution with super pure water. In order to reduce the cost of production, transportation and storage, a composition with a higher concentration is generally provided, and then used after dilution with super pure water in end use. The composition is typically diluted at a multiplication in the range of 10 and 60, depending on the practical use. In the case of special requirements, such as saving processing time, a cleaning composition stock solution with a higher concentration can be used directly to clean the wafers.

The cleaning composition of the invention can be used at room temperature. The cleaning composition is placed in contact with the copper-containing semiconductor wafers that have been treated by chemical mechanical planarization for an effective period of time, which can effectively remove the residual contaminants from the surfaces of the wafers after polishing and simultaneously provide the copper wires with a better surface roughness. In general, when a lower concentration is used , a longer contact time (e.g. 1-3 min) is needed; and when a higher concentration is used , only a short contact time (e.g. shorter than 1 min) is needed. In practical use, the optimal correlation between the concentration of the cleaning composition and the contact time can be determined by try-and-error method.

The present invention will be further illustrated by the following examples, but is not intended to be limited by the examples. Any modifications and variations that can be easily achieved by those having ordinary skill in the art are contemplated within the scope of the invention.

EXAMPLE 1

Considering the factors regarding the concentrations of piperazine, diethanolamine and triethanolamine, cleaning solutions with different compositions (No. 1~8) were prepared using Taguchi Method L8, and the effects of the components, i.e. water, piperazine, diethanolamine and ammonia solution (No. 9~12) were studied, and then 40 X diluted solutions of the compositions were measured for the ability to dissolve copper and the saturation solubility of BTA.

The ability to dissolve copper was measured by cutting a blank copper wafer into chips each with 1.5 cm both in length and width, pretreating the chips to remove copper oxide from the surfaces prior to being dipped into a 50 ml test solution, and then taking out the chips after 1 min. The concentration of copper ions in the solution was measured by ICP-MS.

The saturation solubility of BTA was measured by placing the test solution under the condition of the constant temperature of 25° C., adding an excessive amount of BTA while stirring the solution to dissolve BTA, and then filtering off insoluble substances from the test solution after 4 hours. The BTA concentration in the solution was analyzed by high performance liquid chromatography (HPLC).

TABLE 1

The ability to dissolve copper and the saturation solubility of BTA for different cleaning compositions

| No. | Component: Piperazine | Component: Diethanolamine | Component: Triethanolamine | Dilution Multiplication | Dissolution Ability for Copper (ppb) | Saturation Solubility of BTA (%) |
|---|---|---|---|---|---|---|
| 1 | 7.2% | 9.0% | 13.5% | 40 | 25.3 | 2.76 |
| 2 | 7.2% | 9.0% | 20.0% | 40 | 25.7 | 2.86 |
| 3 | 10.8% | 9.0% | 13.5% | 40 | 21.1 | 2.92 |
| 4 | 10.8% | 9.0% | 20.0% | 40 | 23.1 | 3.02 |
| 5 | 7.2% | 13.5% | 13.5% | 40 | 19.3 | 2.90 |
| 6 | 7.2% | 13.5% | 20.0% | 40 | 20.6 | 3.02 |
| 7 | 10.8% | 13.5% | 13.5% | 40 | 20.1 | 3.08 |
| 8 | 10.8% | 13.5% | 20.0% | 40 | 22.6 | 3.18 |
| | Control Examples | | | | | |
| 9 | Super pure water | | | — | <2 | 2.00 |
| 10 | Piperazine 9.0% | | | 40 | <2 | 2.40 |
| 11 | Diethanolamine 16.9% | | | 40 | 16.0 | 2.60 |
| 12 | Diethanolamine 16.9% Ammonia solution 3.0% | | | 40 | 42.9 | 3.43 |

The results for the above compositions 9 and 10 show that both water and piperazine exhibit no dissolution ability for copper metal, while the addition of piperazine can increase the saturation solubility of BTA in the cleaning composition. The results for the above compositions 11 and 12 indicate that the addition of ammonia solution can significantly increase the etching dissolution rate of copper metal and can obviously increase the saturation solubility of BTA in the cleaning composition. The results for the above compositions 1~8 and 11 show that the alcohol amine has the etching dissolution ability for copper metal and also can increase the saturation solubility of BTA in the cleaning composition. With a stronger dissolution ability for copper metal and a higher saturation solubility of BTA, the cleaning composition will allow a better cleaning effect on the contaminants on copper metal and the organic contaminants such as BTA to be achieved. However, it should be noted that an improper etching dissolution ability for copper metal (e.g., too fast and/or unevenly) will adversely affect the roughness.

EXAMPLE 2

The cleaning compositions shown in Example 1 were used to clean a polished blank copper wafer on Ontrak(a cleaning table). The cleaning time was two minutes and the flux of the cleaning agent was 600 ml/min. After cleaning, the surface roughness (the average roughness Ra and the root mean square roughness Rq) of the copper wafer was measured by atomic force microscope (AFM).

TABLE 2

The surface roughness of the copper wafer cleaned with different cleaning compositions

| No. | Component: Piperazine | Component: Diethanolamine | Component: Triethanolamine | Dilution Multiplication | Surface Roughness Ra (nm) | Surface Roughness Rq (nm) |
|---|---|---|---|---|---|---|
| 1 | 7.2% | 9.0% | 13.5% | 40 | 0.616 | 0.813 |
| 2 | 7.2% | 9.0% | 20.0% | 40 | 0.699 | 0.997 |
| 3 | 10.8% | 9.0% | 13.5% | 40 | 0.663 | 0.888 |
| 4 | 10.8% | 9.0% | 20.0% | 40 | 0.842 | 1.153 |
| 5 | 7.2% | 13.5% | 13.5% | 40 | 0.677 | 0.885 |
| 6 | 7.2% | 13.5% | 20.0% | 40 | 0.714 | 0.945 |
| 7 | 10.8% | 13.5% | 13.5% | 40 | 0.721 | 0.977 |
| 8 | 10.8% | 13.5% | 20.0% | 40 | 0.763 | 0.986 |

TABLE 2-continued

| The surface roughness of the copper wafer cleaned with different cleaning compositions | | | | | | |
|---|---|---|---|---|---|---|
| | Component | | | Dilution | Surface Roughness | Surface Roughness |
| No. | Piperazine | Diethanolamine | Triethanolamine | Multiplication | Ra (nm) | Rq (nm) |
| | Control Examples | | | | | |
| 9 | Super pure water | | | — | — | — |
| 10 | Piperazine 9.0% | | | 40 | 0.590 | 0.732 |
| 11 | Diethanolamine 16.9% | | | 40 | 0.785 | 1.040 |
| 12 | Diethanolamine 16.9% Ammonia solution 3.0% | | | 40 | 9.555 | 15.234 |

Comparisons between Composition 1 and Composition 3, Composition 1 and Composition 2, and Composition 1 and Composition 5 reveal that both a higher amount of piperazine and a higher amount of alcohol amine will increase the surface roughness, but still maintain it at a good level. This shows that the cleaning compositions of the invention at a wide range of concentration may not only etch and dissolve copper metal, but also maintains a better surface roughness of copper metal. The results from Composition 12 show that ammonia solution will seriously erode the copper surface, thus resulting in a very bad roughness. It has been found from the results from Composition 10 that since piperazine itself doesn't have etching dissolution ability for copper metal, the treated copper surface still exhibits an excellent roughness.

EXAMPLE 3

Blank copper wafers were dipped into a polishing slurry containing the corrosion inhibitor BTA used in copper processing for 1 min so as to be contaminated. After contamination, they were rinsed with super pure water on Ontrak (a cleaning table) for 18 seconds followed by spin drying. Then, the numbers of the particles on the contaminated wafers were measured using a TOPCON WM-1700 wafer particle counter. The contaminated wafers on which the particle numbers had been determined were scrubbed on Ontrak (a cleaning table) with different cleaning compositions for 2 min, and finally rinsed with super pure water for 18 sec followed by spin drying. Again, the particle numbers on the cleaned wafers were measured using TOPCON WM-1700 wafer particle counter. The removal rate of each cleaning composition for the particulate contaminants on the wafer surface was calculated.

TABLE 3

| The removal effect of the cleaning compositions for the particles on the surface of the copper wafer | | | | |
|---|---|---|---|---|
| No. | Original Composition | Composition After Dilution | pH After Dilution | Removal Rate of Contaminants |
| 10 | Piperazine 9.0% | Piperazine 0.225% | 11.1 | 79.1% |
| 11 | Diethanolamine 16.9% | Diethanolamine 0.423% | 10.7 | 75.0% |
| 13 | Piperazine 9.0% Diethanolamine 16.9% | Piperazine 0.225% Diethanolamine 0.423% | 11.2 | 92.1% |
| 14 | Piperazine 9.0% Triethanolamine 16.9% | Piperazine 0.225% Triethanolamine 0.423% | 11.4 | 87.8% |
| 1 | Piperazine 7.2% Diethanolamine 9.0% Triethanolamine 13.5% | Piperazine 0.180% Diethanolamine 0.225% Triethanolamine 0.338% | 11.3 | 94.1% |
| 8 | Piperazine 10.8% Diethanolamine 13.5% Triethanolamine 20.0% | Piperazine 0.270% Diethanolamine 0.338% Triethanolamine 0.500% | 11.4 | 96.7% |

The results shown in the above table reveal that good cleaning results cannot be achieved by using piperazine or alcohol amine alone, while the cleaning efficacy can be significantly increased when piperazine and alcohol amine are used together.

What is claimed is:

1. An aqueous cleaning composition used in post chemical mechanical planarization, consisting of (a) 0.1 to 15 wt % of a nitrogen-containing heterocyclic organic base; (b) 0.1 to 35 wt % of an alcohol amine; and (c) water, wherein the nitrogen-containing heterocyclic organic base is selected from the group consisting of piperazine, 2-(1-piperazine)ethanol, and 2-(1-piperazine)ethylamine, and wherein the alcohol amine is selected from the group consisting of ethanolamine, diethanolamine, triethanolamine, and propanolamine.

2. The composition according to claim 1, consisting of (a) 0.1 to 15 wt % of piperazine; (b) 0.1 to 35 wt % of an alcohol amine, wherein the alcohol amine is selected from the group consisting of diethanolamine and triethanolamine; and (c) water.

3. The composition according to claim 1, wherein the nitrogen-containing heterocyclic organic base is used in an amount of 0.1 to 10 wt %.

4. The composition according to claim 1, wherein the nitrogen-containing heterocyclic organic base is used in an amount of 0.2 to 10 wt %.

5. The composition according to claim 1, wherein the alcohol amine is used in an amount of 0.1 to 30 wt %.

6. The composition according to claim 1, wherein the alcohol amine is used in an amount of 0.5 to 25 wt %.

7. The composition according to claim 1, wherein the nitrogen-containing heterocyclic organic base and alcohol amine are present in the composition in respective amounts such that, when the composition is used to scrub copper contaminated with benzotriazole, a higher percentage of the benzotriazole is removed than would be removed by either the heterocyclic organic base or alcohol amine separately.

8. An aqueous cleaning composition used in post chemical mechanical planarization, consisting of(a) 0.1 to 15 wt % of a nitrogen-containing heterocyclic organic base; (b) 0.1 to 35 wt % of alcohol amine compounds consisting of diethanolamine and triethanolamine; and (c) water, wherein the nitrogen-containing heterocyclic organic base is selected from the group consisting of piperazine, 2-(1-piperazine)ethanol, and 2-(1-piperazine)ethylamine.

* * * * *